United States Patent [19]

Zakow

[11] 4,212,175

[45] Jul. 15, 1980

[54] CABLE LOCK FOR PORTABLE PROPERTY

[75] Inventor: Gilbert Zakow, Bayside, N.Y.

[73] Assignee: Componentry Research & Development Enterprises, Inc., Bayside, N.Y.

[21] Appl. No.: 969,692

[22] Filed: Dec. 15, 1978

[51] Int. Cl.[2] ..... E05B 73/00

[52] U.S. Cl. ..... 70/58

[58] Field of Search ..... 70/58, 59, 57, 60, 63, 70/18, 14, 49, 30

[56] References Cited

U.S. PATENT DOCUMENTS

| | | | |
|---|---|---|---|
| 3,211,408 | 10/1965 | Schaefer | 70/58 |
| 3,690,130 | 9/1972 | Eutaler | 70/59 |
| 3,985,183 | 10/1976 | Fernbaugh | 70/58 |
| 4,055,973 | 11/1977 | Best | 70/58 |
| 4,069,691 | 1/1978 | Simpson | 70/59 |

*Primary Examiner*—Robert L. Wolfe

*Attorney, Agent, or Firm*—Kirschstein, Kirschstein, Ottinger & Cobrin

[57] ABSTRACT

The lock for a plurality of items of portable personal property includes a plurality of cables extending from a locking box which is mountable to a mounting surface. The items of personal property are mounted to the cables, and at least one end of each cable is secured to one of a plurality of nipples disposed within the box. The locking box has an inner box member and an outer box member which are mateable to form the box; the width of the opposed side walls of both the inner box member and the outer box member are generally equal, so that jimmying, or forced opening of the box is precluded since the free edges of the side walls of the outer box member are contiguous with the fixed planar surface when the assembled box is mounted to the surface.

28 Claims, 11 Drawing Figures

CABLE LOCK FOR PORTABLE PROPERTY

BACKGROUND OF THE INVENTION

1. Field of the Invention

A cable lock to prevent the theft of portable personal property such as office equipment, or school or hospital equipment, or reference library books.

2. Description of the Prior Art

The theft of portable personal property is a ubiquitous problem. Such theft is not only prevalent during burglaries, but also in all public and many private places, such as business offices, where even office workers at times succumb to temptation, and steal diverse items of office machinery such as electronic calculators, dictating machines, typewriters, etc. It is a well-known fact that in recent years, there has been a sharp rise in crimes of this nature due perhaps to a general lessening of the loyalty of salaried workers to their employers. Needless to say, many persons have no compunctions or inhibitions at all against the appropriation of portable personal property from a place of employment. The prospect of possibly or eventually being apprehended, and even imprisoned, has not proven to be a deterrent, particularly since the value of the items appropriated does not approach the magnitude which warrants a prison sentence, i.e. the prisons in recent years have tended to become the province for the incarceration of those convicted of more serious crimes, such as crimes against the person, felonies such as armed robbery, or crimes such as embezzlement, where large amounts of monies are stolen.

Thus, the actual fact that a person may be imprisoned as a convicted felon, and removed from society, is not an effective deterrent to the theft of portable personal property.

Thus, in recent years, there has been a proliferation of anti-theft security devices and deterrents, to prevent the loss of portable personal property from an office, as well as from the home. The applications of such devices are virtually unlimited and extend to the protection of almost any movable machine and equipment, in schools, hospitals, universities, offices and industry, motels, hotels, nursing homes, institutions and, in fact, anywhere there is equipment to be protected. The uses of such devices are as varied as the equipment being protected, e.g. typewriters, electronic or manual calculators, tomes, comptometers, movable desk-top computer equipment, cash registers, billing machines, adding machines, vending machines, audio-visual equipment, photocopiers, hi-fi components, auto tape decks, citizen band and ship-to-shore radios, checkwriters, display merchandise, microscopes, television sets, scientific and laboratory equipment and instruments, projectors, dictating and taping equipment, electronic devices, etc. may be secured in any and all of the diverse facilities mentioned above.

It is evident that in most instances, it would be desirable to install an anti-theft device of this nature which concomitantly protects a plurality of items located in a single establishment such as an office. It is also apparent that installation of a viable anti-theft device can avoid and preclude serious financial and production losses, including hidden losses only recognized by perceptive people. Thus, having equipment taken is more than just an inconvenience, with lost production in offices and elsewhere, while overhead remains a burdensome fixed expense item. There are also costly hidden charges such as insurance deductibles, applicable sales taxes, depreciation discounts, higher replacement costs due to inflation, and finally, a possible increase in insurance premiums, or even the refusal to renew insurance policies which could lead to a serious capital loss if further theft occurs after the existing policy expires or lapses.

SUMMARY OF THE INVENTION

1. Purposes of the Invention

It is an object of the present invention to provide an improved cable lock for portable property.

Another object is to provide an improved article of manufacture which deters and prevents the theft of portable personal property.

A further object is to provide a cable lock for securing a plurality of items of portable personal property against theft.

An additional object is to provide a cable lock for portable personal property which is strong and rugged, inexpensive, easily installed, and yet highly effective.

Still another object is to provide a cable lock for portable personal property which is virtually impossible to break, jimmy or pry open or away from a mounting surface once it is mounted to such a surface.

Still a further object is to provide a cable lock for portable personal property which accommodates the shifting, moving or displacement of the secured items of personal property from one location to another nearby location, without necessitating the opening of the cable lock or the disconnecting of the item or items from a cable to which they are mounted.

Still an additional object is to provide a cable lock for portable personal property which is relatively cheap and is easily fabricated and manufactured from inexpensive materials of construction, such as steel.

An object is to provide a cable lock for portable personal property which is very versatile, easily and simply installed virtually anywhere, and is a well designed and very secure deterrent to prevent equipment loss.

An object is to provide a cable lock for portable personal property which is a complete machanical locking system that successfully prevents machine pilferage yet allows full cable length movement.

An object is to provide a cable lock for portable personal property which achieves access to and greater productivity in the operation of an office and other facilities and installations, because the items of portable personal property may be used and then moved from one unmarred desk to another, even though locked against unauthorized removal.

An object is to provide a cable lock for portable personal property which allows complete control, internally, of items in the office and elsewhere, without embarrassment or strict rules about moving or using office equipment.

An object is to provide a cable lock for portable personal property which is tamper-proof and pry-proof.

An object is to provide a cable lock for portable personal property which permits easy service and maintenance of the secured items of equipment, machines, etc.

An object is to provide a cable lock for portable personal property which can protect almost any movable machine or other item of equipment or property.

An object is to provide a cable lock for portable personal property which is tamper-proof and provides positive around-the-clock security for all types of valuable items of property, such as office machines.

An object is to provide a cable lock for portable personal property which has virtually unlimited applications in diverse places and facilities and which has uses as varied as the equipment being protected.

An object is to provide a cable lock for portable personal property which has a locking box which may be mounted on a wall, table-top or side, under or on a desk, or virtually anywhere else where there is a fixed planar surface, at the discretion of the installer.

These and other objects and advantages of the present invention will become evident from the description which follows.

2. Brief Description of the Invention

Within the context of the present invention, the term cable or cable means will be understood to encompass and include any and all of diverse cables, such as strand woven and plastic coated aircraft cable, armored cable, wire or wire rope, metal chain, any flexible linear configuration of strands of material assembled and laid up together, usually by being woven or stranded together or twisted around a central core, etc.

In the present invention, the cable lock for portable personal property includes a rectangular parallelepiped locking box having an inner box member and an outer box member, means to detachably secure the outer box member to the inner box member, a plurality of spaced nipples, a plurality of flexible cable means, and means to secure at least one end of each of the cable means, preferably when extended through a nipple. At least one discrete item of portable property is mountable to each of the cable means.

With regard to the locking box, each of the aforementioned box members has three longitudinal walls and two opposed end walls. The three longitudinal walls of each of the box members consist of two opposed side longitudinal walls and a middle longitudinal wall. The two opposed side longitudinal walls of each of the box members are spaced apart in registration and straddle the middle longitudinal wall of the respective box member. Each longitudinal edge of the middle longitudinal wall is joined to a longitudinal edge of one of the two opposed side longitudinal walls of each box member. The inner box member is slidably engageable with and mateable with the outer box member, so that when the box members are mated and the locking box is integrally assembled, and when the opposed side longitudinal walls of the inner box member are within the outer box member, then the middle longitudinal wall of the inner box member is opposed to the middle longitudinal wall of the outer box member. In addition, in the final assembled configuration, each of the opposed side longitudinal walls of the inner box member is contiguous with one of the opposed side longitudinal walls of the outer box member, and the inner box member is mated to and mounted in mirror image relationship within the outer box member.

With specific regard to dimensioning, the spacing between opposed side longitudinal walls of the inner box member is less than the spacing between opposed side longitudinal walls of the outer box member, and the spacing between opposed end walls of the inner box member is less than the spacing between opposed end walls of the outer box member, so that the inner box member is receivable within the outer box member. In accordance with the present invention, the width of the opposed side longitudinal walls of both the inner box member and the outer box member are generally equal. The middle longitudinal wall of either box member is mountable to a mounting surface.

With regard to the plurality of spaced nipples, the nipples are mounted to one side longitudinal wall of the inner box member and extend into the inner box member generally perpendicular to the one side longitudinal wall of the inner box member. Each of the nipples extends from one of a plurality of openings in the one side longitudinal wall of the inner box member, so that a continuous rectilinear passage is provided into the inner box member at each nipple.

One side longitudinal wall of the outer box member is provided with a plurality of parallel slots. Each of the slots extends from a free edge of the outer box member perpendicularly inwards from the free edge, and towards the middle longitudinal wall of the outer box member, and terminates short of the middle longitudinal wall of the outer box member.

An end of each of the cable means is receivable through a slot and an opening in the juxtaposed side longitudinal walls of the box members, so that as mentioned supra, this end of each of the cable means may be secured when extended through a nipple.

In one embodiment of the invention, the structural configuration described supra includes an enlargement at one end of each of the flexible cable means, so that an item of portable property is mountable to the one end of each cable means. In this embodiment, preferably a washer is freely mounted on each cable means, which washer is juxtaposable with the enlargement at the one end of the cable means. With or without the washer, as will appear infra, an item of portable property is mountable to the one end of each cable means by extending the other end of the cable means through a hole or opening in the body or wall of the item, and pulling the cable means through the hole or opening until the enlargement, with or without the interposed or intermediate washer, engages a fixed surface of the body or wall of the item. Thus, since the other end of the cable means is then secured to the locking box, the item of portable property, usually portable personal property, cannot be removed from the premises, such as an office or other business or factory establishment. With specific regard to the aforementioned embodiment, this enlargement is spherical, e.g. a swaged ball end.

In a preferred embodiment, the means to secure at least one end of each of the cable means to its respective nipple is a set screw which extends transversely through a wall of the nipple and is mounted in a threaded passage in the wall of the nipple. Preferably, the middle longitudinal wall of the inner box member is provided with a plurality of spaced openings, so that the middle longitudinal wall of the inner box member is mountable to a mounting surface by mounting a fastening means through each of the spaced openings and into the mounting surface, which is preferably a fixed planar surface.

Typically, the means to detachably secure the outer box member to the inner box member comprises a lock means. In a preferred embodiment, the lock means is mounted to the middle longitudinal wall of the outer box member, and the inner end of the lock means terminates with a dependent lateral cam which is perpendicularly mounted to the inner end of the lock means. Thus, the cam pivots about its mounted end when a key is inserted into the lock means and the lock means is rotated; one side longitudinal wall of at least the inner box member is provided with a slot opposite to the cam so that when the cam is pivoted, the end of the cam opposite to its mounted end fits into the slot thus securing the outer box member to the inner box member and thereby locking the box. Preferably, both the slot and the plurality of nipples are disposed in conjunction with the same one side longitudinal wall of the inner box member.

Typically, the present device is installed in an office, and the item of portable property is a discrete item of office equipment, e.g. a calculator.

Generally, the three longitudinal walls of each of the box members are planar and of a rectangular shape, and the opposed side longitudinal walls of each of the box members are generally perpendicular to the respective middle longitudinal wall of the box member.

The present cable lock for portable property, specifically a cable lock for portable personal property, provides numerous salient advantages. The present device is an improved article of manufacture consisting of an improved cable lock for portable property which deters and prevents the theft of portable personal property. The present cable lock serves to secure a plurality of items of portable personal property against theft. Another advantage is that the present cable lock is strong and rugged, inexpensive, easily installed, and yet highly effective for its function of curtailing and preventing the theft and loss of portable personal property. The present cable lock is virtually impossible to break, jimmy or pry open or away from a fixed, planar surface, once it is mounted to such a surface. Another advantage is that the cable lock accommodates the shifting, moving or displacement of the secured items of personal property from one location to another nearby location, without necessitating the opening of the cable lock or the disconnecting of the item or items from a cable to which they are mounted. A further advantage is that the present cable lock is relatively cheap and is easily fabricated and manufactured from inexpensive materials of construction, such as steel, e.g. mild carbon steel. An additional advantage is that the cable lock is very versatile, easily and simply installed virtually anywhere, and is a well-designed and very secure deterrent to prevent equipment and portable machinery loss. The present cable lock is a complete mechanical locking system that successfully prevents machine pilferage, yet allows full cable length movement. The cable lock for portable personal property of the present invention also achieves access to a greater productivity in the operation of an office and other facilities and installations, because the items of portable personal property may be used and then moved from one unmarred desk to another, even though continuously locked against unauthorized removal from the premises. The present cable lock allows complete control, internally, of items in the office and elsewhere, without embarrassment or strict rules about moving or using office equipment. The present cable lock is tamper-proof and pry-proof. The present cable lock for portable personal property permits easy service and maintenance of the secured items of equipment, machines, etc. The present cable lock can protect almost any movable machine or other item of equipment. The cable lock is easily detachable from the mounting surface for repair purposes.

Thus, the present cable lock, which is tamper-proof, provides positive around-the-clock security for all types of valuable items of property, such as office machines. The present cable lock has virtually unlimited applications in diverse places and facilities, and has uses as varied as the equipment being protected. Finally, an advantage is that the present cable lock has a locking box which may be mounted on a wall, table-top or side, under or on a desk, or virtually anywhere else where there is a fixed planar surface. Of course, mounting surfaces other than planar surfaces can also be utilized.

The invention accordingly consists in the features of construction, combination of elements and arrangement of parts, which will be exemplified in the device and article of manufacture hereinafter described and of which the scope of application will be indicated in the appended claims.

BRIEF DESCRIPTION OF THE DRAWINGS

In the accompanying drawings in which are shown several of the various possible embodiments of the invention.

DETAILED DESCRIPTION OF THE PREFERRED EMBODIMENTS

Figure 1:
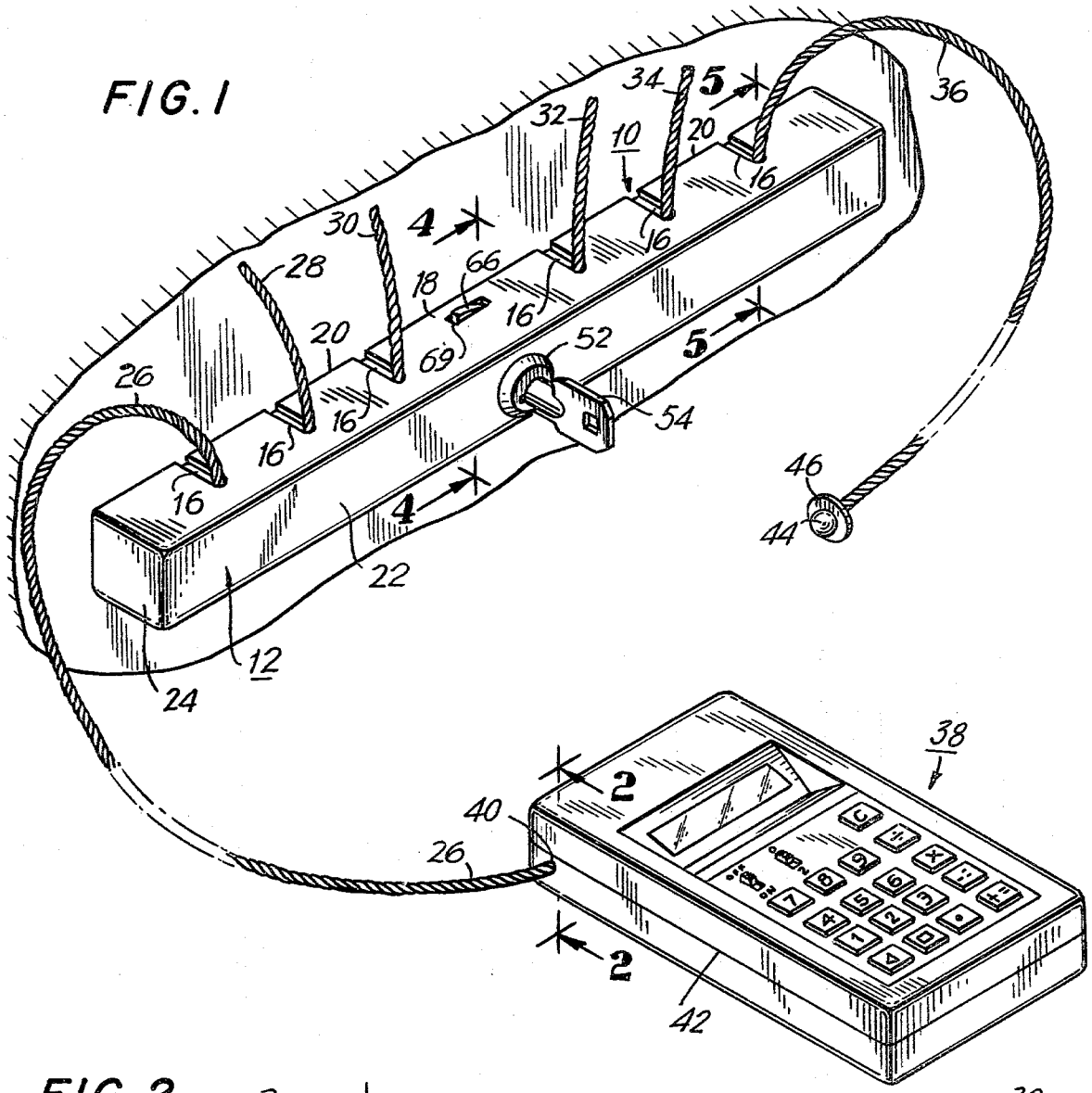
FIG. 1 is a perspective view of the present cable lock for portable personal property as installed against a fixed planar surface; also shown is an item of portable personal property as attached to one of the plurality of cable means.
Figure 4:
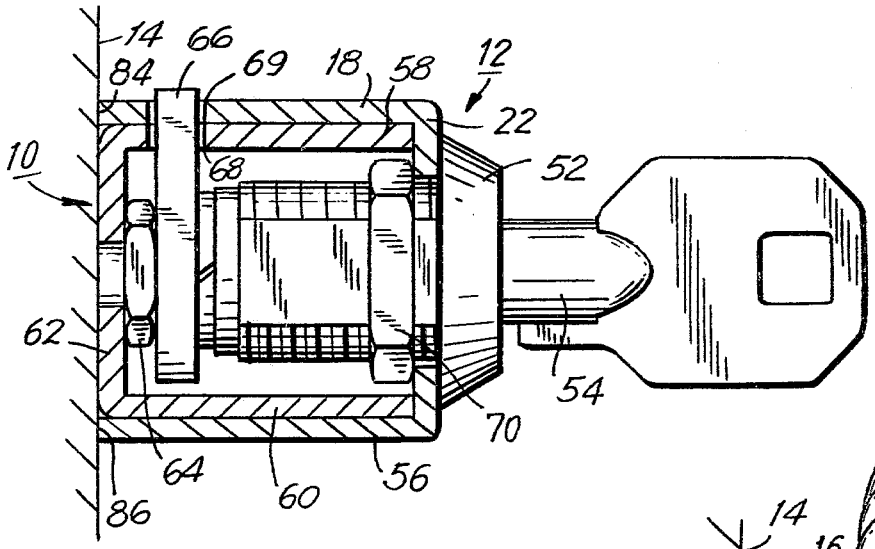
FIG. 4 is a sectional elevation view taken substantially along the line 4—4 of FIG. 1.

Referring now to FIGS. 1 and 4, the cable lock for portable personal property includes an inner box member 10 and an outer box member 12; as shown, the members 10 and 12 are mated to form a rectangular parallelepiped locking box. The locking box as shown is emplaced and mounted against a fixed planar mounting surface 14.

The outer box member 12 is provided with a plurality of parallel and spaced apart slots 16, each of which extends inwards in the side longitudinal wall 18 of the outer box member 12 from a free edge 20 of the wall 18, which edge 20 is flush against the surface 14. The middle longitudinal wall 22 and the end wall 24 of the outer box member 12 are also shown.

Figure 2:
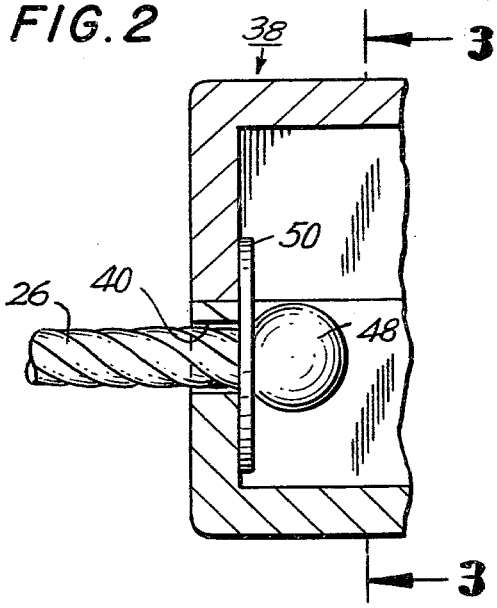
FIG. 2 is a partial sectional elevation view taken substantially along the line 2—2 of FIG. 1.
Figure 3:
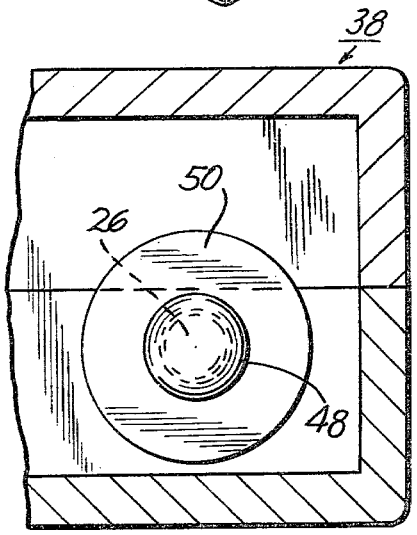
FIG. 3 is a sectional elevation view taken substantially along the line 3—3 of FIG. 2.

A plurality of cables 26, 28, 30, 32, 34 and 36 extend from the locking box through the slots 16; one end of each of the cables is secured to the inner box member 10. An item of portable personal property 38, in this case consisting of a calculator, is attached to the other end of the cable 26, with the other end of the cable 26 extending through a hole or opening 40 in the item 38 disposed below the interface 42 between the two mated halves of the item 38, so that the item 38 is secured against theft. The means for preventing the removal of the other end of the cable 26 from the hole or opening 40 is comparable to the elements shown at the other end of the cable 36, which elements consist of a terminal enlargement 44 together with a juxtaposed washer 46 mounted to the cable 36. The enlargement 44 in this embodiment of the invention is spherical, i.e. a swaged ball end 44, however, it will be understood by those skilled in the art that alternative enlargement configurations may be provided, e.g. a pear-shaped, conical or cylindrical enlargement may alternatively be provided in practice. In any event, the other end of the cable 26, extending within item 38 through opening 40, is provided with terminal elements comparable to the elements 44 and 46, which terminal elements are shown in FIG. 2 as the respective swaged ball end 48 and washer 50 at the other end of the cable 26. The washer 50 on cable 26 within item 38 is contiguous with the inner wall of item 38 so that attrition of the item 38 at and adjacent to opening 40 due to impact of swaged ball end 48 is prevented. Such attrition could arise if item 38 is frequently handled or moved. FIG. 3 shows the coaxial orientation of the swaged ball end 48 and the washer 50 on the cable 26 below interface 42.

FIG. 1 also shows a lock means 52 centrally mounted on the middle longitudinal wall 22 of the outer box member 12. The lock means 52 extends into the locking box and a key 54 is shown inserted into the lock means 52.

FIG. 4 shows the lock means 52 and key 54 to larger scale. FIG. 4 also shows the side longitudinal wall 56 of the outer box member 12. It is to be noted that the free ends of the walls 18 and 56 are flush with the fixed planar surface 14, and that the width of the side longitudinal walls 18 and 56 is generally equal to the width of the side longitudinal walls 58 and 60 of the inner box member 10, and that the inner box member 10 is also provided with a middle longitudinal wall 62. The lock means 52 terminates with an inner nut 64 which holds a dependent lateral cam 66 to the lock means 52. The cam 66 extends into a slot 68 in the side juxtaposed longitudinal wall 58 of the inner box member 10 and also into a slot 69 in the side longitudinal wall 18 of the outer box member 12. Another inner nut 70 holds the lock means 52 to the inner surface of the middle longitudinal wall 22.

Figure 5:
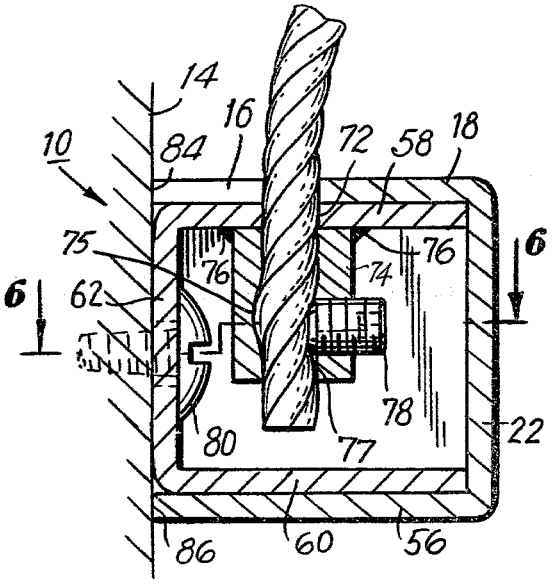
FIG. 5 is a sectional elevation view taken substantially along the line 5—5 of FIG. 1.
Figure 6:
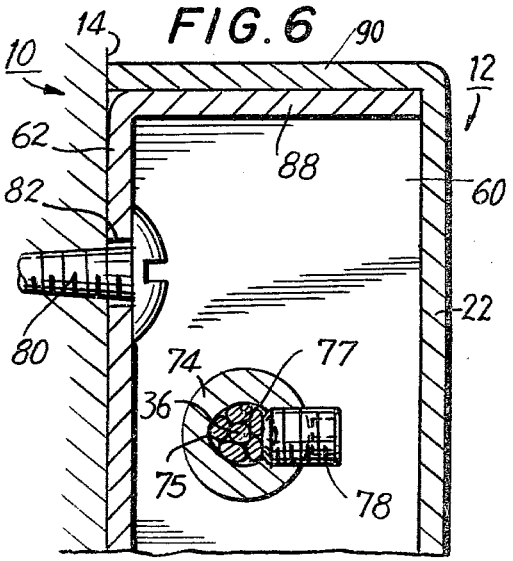
FIG. 6 is a sectional plan view taken substantially along the line 6—6 of FIG. 5.

FIGS. 5 and 6 show the preferred mode of securing the one end of the cable means 36 to the inner box member 10. The one end of the cable means 36 extends through the slot 16, a hole or opening 72 in the wall 58, and a passage 77 in the inner nipple 74 within the locking box. The nipple 74 is mounted to the inner surface of the wall 58 by welding 76 or the like. A threaded set screw 78 pinches the end of the cable means 36 within nipple 74. A generally circular recess 75 is concentric with the longitudinal axis of the screw 78. The set screw 78 pushes the opposite side of the cable means into the recess 75 so that a portion of the cable means is offset radially with respect to the symmetry axis of the passage 77. The interference-type fit affirmatively prevents removal of the cable means 36.

A suitable fastening means, such as an anchor bolt or a screw 80 extends through a hole 82 in the wall 62 and holds the locking box against the surface 14. The locking box is thus mounted to the surface 14, by initially separating inner box member 12, so that there is ready access to the holes such as 82. Then the inner box member 10 is placed against the surface 14 and the fastening means is screwed into the surface 14 through the holes 82, so that the inner box member 10 is held against the surface 14. Then, the one cable ends are inserted through their respective nipples. Finally, the outer box member 12 is emplaced and the key 54 is turned to manipulate the lock means 52 and thereby to pivot cam 66 into slots 68 and 69 (FIG. 4).

It is to be noted, with specific reference to FIG. 5, that the fastening means 80 is now inaccessible and the locking box cannot be screwed, pried or jimmied away from the surface 14, especially since the width of the outer side walls 18 and 56 and the inner side walls 58 and 60 are generally equal, so that only the outer surface of the outer box member is accessible and the free ends 84 and 86 of the respective outer side walls 18 and 56 are flush against the surface 14.

FIG. 6 shows the end walls 88 and 90 of the respective inner box member 10 and outer box member 12.

Figure 7:
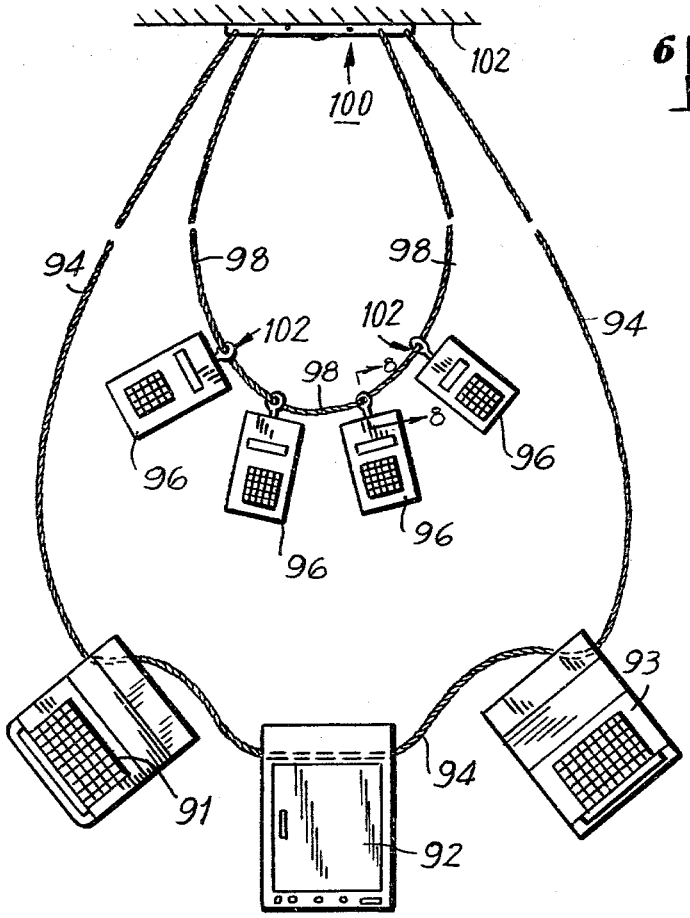
FIG. 7 is a plan view of alternative embodiments of the invention.

FIG. 7 shows an alternative embodiment of the invention in which a first plurality of items 91, 92, 93 of portable personal property is mounted to a first cable means 94, and a second plurality of items of portable personal property 96 is mounted to a second cable means 98. In each case, the cable means 94 or 98 extends continuously through all of the respective items 91, 92, 93 or through attachments mounted on the respective items 96. Both ends of each cable means 94 or 98 are separately attached to a locking box 100, which in turn is mounted to a fixed planar surface 102.

Specifically, as for items 91, 93, the cable 94 is inserted through a corner region of the item, i.e. through a side wall and its adjacent end wall. As for item 92, the cable 94 is inserted through the opposite side walls. Of course, these latter approaches assume that there is sufficient room within the item for a cable to pass through. In cases where such room is more limited, the mounting attachments 102 are mounted on the items.

Figure 8:
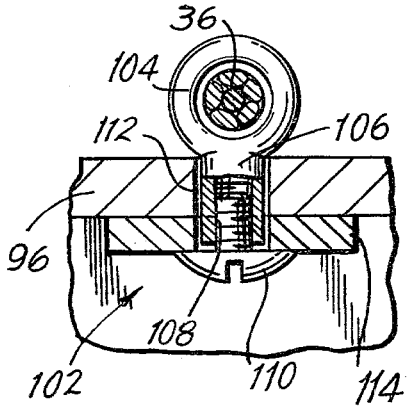
FIG. 8 is a sectional elevation view taken substantially along the line 8—8 of FIG. 7.

As best shown in FIG. 8, the mounting attachments 102 include an eye bolt having a loop portion 104 and a cylindrical body portion 106. Body portion 106 has a tapped passage 108 in which a threaded member such as bolt 110 is threaded. The body portion 106 is insertable through the mounting hole 112 formed in the item 96. The loop portion 104 is located at the outside of the item 96, and the washer 114 cooperates with the bolt 110 to fixedly anchor the attachment, and to properly space the loop portion in a position closely adjacent the exterior wall of the item 96. The opening in the loop portion 104 is dimensioned to receive the cable means 36 with clearance.

Figure 9:
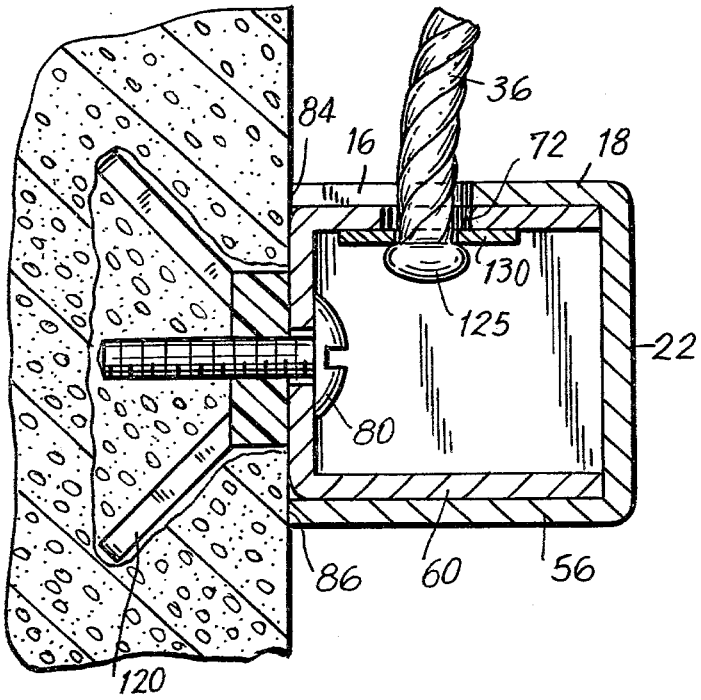
FIG. 9 is a view generally analogous to FIG. 5, but showing an alternative embodiment of the invention mounted on a different mounting surface.

FIG. 9 sets forth another embodiment which is analogous to the one shown in FIG. 5, except in two respects. First, the screw 80 is not shown as being screwed directly into a mounting surface such as a wall, or shelf, or cabinet, or the like, but is shown being screwed directly into an expansion anchor 120 having spreadable legs. This type of mounting is particularly suitable for mounting the cable lock onto masonry and like supporting structures. As noted above, mounting surfaces other than flat planar surfaces can also be employed. For example, in one preferred mode of application, it is desired to secure items, such as luggage, onto a luggage rack comprised of tubular elements of generally circular cross section. In this case, either box member can be fixedly mounted on one of the tubular elements and the cable can be looped through the openings in the various handles of the luggage, in a manner completely analogous to the one shown in FIG. 7 for the items 96.

Another difference between the embodiments of FIG. 9 and FIG. 5 is that the nipples 74 have been eliminated in FIG. 9. The anchoring end of the cable 36 is formed with an enlargement 125. Again, the anchoring end of the cable is inserted through the slot 16 and juxtaposed hole 72. The cross-sectional dimension of the enlargement is slightly smaller than that of hole 72 and is slightly tapered at its lead end so that the enlargement 125 can be inserted into the interior of the locking box with ease. In order to fixedly secure this anchoring end in place, a clip member 130 is mounted with snap-type action on the cable intermediate the enlargement 125 and the locking box. The clip member 130 can be a C-shaped circlip or a conventional E-clip.

Figure 10:
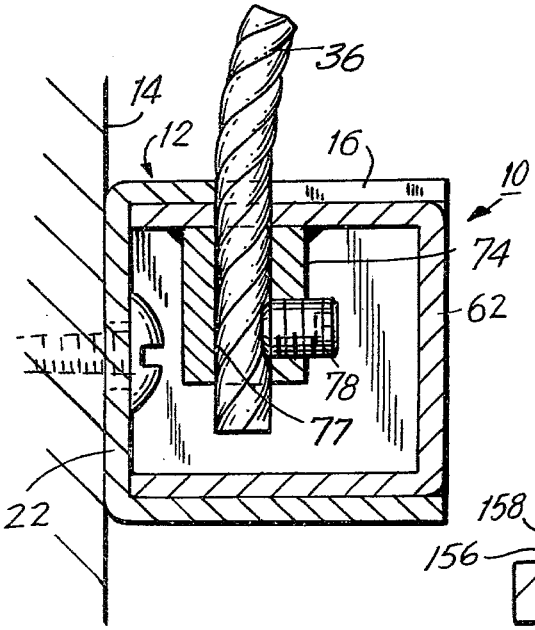
FIG. 10 is a view also analogous to FIG. 5; but showing still another embodiment of the invention.

FIG. 10 shows still another embodiment which is essentially analogous to FIG. 5, except in two respects. First, the dimple-type recess 75 in the passage 77 has been eliminated. The set screw 78 is again operative to urge the opposite side of the cable 36 firmly against and in interference-type engagement with the far wall of the passage to firmly anchor the cable end therein. Secondly, the roles of the middle longitudinal walls 62, 22 of the center and outer box members have been reversed. Now, it is the wall 22 of the outer box member 12 which is mounted on the mounting surface 14, whereas the wall 62 of the inner box member 10 is remotely located from the surface 14.

Figure 11:
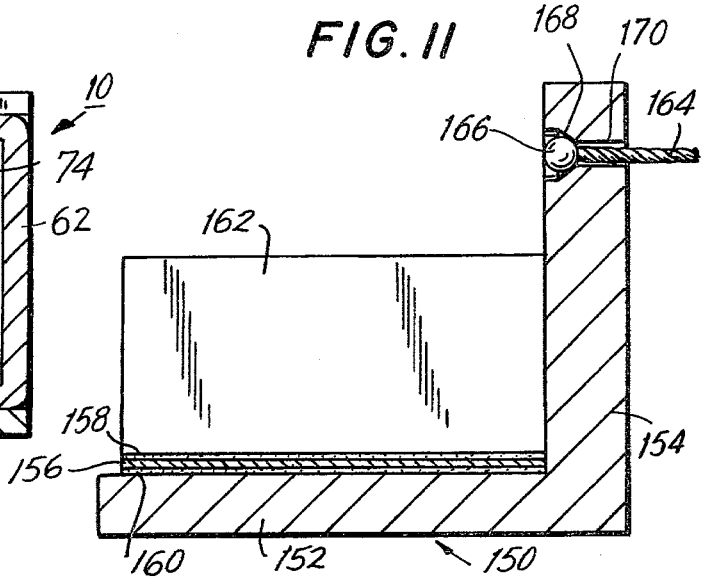
FIG. 11 is a perspective view of yet another embodiment of the invention.

Turning now to FIG. 11, yet another embodiment includes an L-shaped bracket 150 having a base portion 152 and an upright portion 154. A double-sided tape 156 having pressure-sensitive or other type of adhesive layers 158, 160, on each of its opposite major surfaces is interposed between base portion 152 and the item 162 to be protected from theft. The item 162 and the base portion 152 adhere respectively to the layers 158, 160 with an adhesion bond of sufficient strength to resist pulling removal forces.

The cable means 164 has an anchoring end formed with an enlargement 166. A countersunk recess 168 serves as an anchoring seat for the enlargement 166, and a through channel 170 extends from the recess 168 through the upright portion 154. The cable means 164 extends through the channel 170, and the non-illustrated end of the cable means 164 is anchored to a stationary structure such as a table leg, or directly to a wall or other mounting surface, or to a locking box in the manner described above.

If desired, the bracket 150 need not be L-shaped, but can have any configuration, e.g. a substantially planar shape. In this preferred planar shape, the bracket can be attached by adhesion to a portion of a book or any other piece of portable equipment to be protected.

Of course, configurations other than a parallelepiped box can be employed. For example, a circular outer box member can be mated with a circular inner box member. The cables can then be deployed in circumferential direction about the circular box to thereby provide an aesthetic appearance.

Similarly, locks other than cam locks can be used.

It thus will be seen that there is provided a cable lock for portable property which achieves the various objects of the invention and which is well adapted to meet the conditions of practical use.

As various possible embodiments might be made of the above invention, and as various changes might be made in the embodiments set forth above, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention there is claimed as new and desired to be secured by Letters Patent:

1. A cable lock for portable property comprising a rectangular parallelepiped locking box, said locking box having an inner box member and an outer box member, each of said box members having three longitudinal walls and two opposed end walls;

the three longitudinal walls of each of said box members consisting of two opposed side longitudinal walls and a middle longitudinal wall, the two opposed side longitudinal walls of each of said box members being spaced apart in registration and straddling the middle longitudinal wall of the respective box member, each longitudinal edge of the middle longitudinal wall being joined to a longitudinal edge of one of the two opposed side longitudinal walls of each box member, the inner box member being slidably engageable with and mateable with the outer box member, so that when said box members are mated and said locking box is integrally assembled, and when the opposed side longitudinal walls of said inner box member are within said outer box member, the middle longitudinal wall of the inner box member is then opposed to the middle longitudinal wall of the outer box member, and each of the opposed side longitudinal walls of the inner box member is contiguous with one of the opposed side longitudinal walls of the outer box member, and said inner box member is mated to and mounted in mirror image relationship within said outer box member;

the spacing between opposed side longitudinal walls of the inner box member being less than the spacing between opposed side longitudinal walls of the outer box member, the spacing between opposed end walls of the inner box member being less than the spacing between opposed end walls of the outer box member, so that the inner box member is receivable within the outer box member, the width of the opposed side longitudinal walls of both the inner box member and the outer box member being substantially equal, the middle longitudinal wall of one of the box members being mountable to a fixed mounting surface;

means to detachably secure the outer box member to the inner box member;

a plurality of openings in said one side longitudinal wall of the inner box member, so that a continuous rectilinear passage is provided into said inner box member;

one side longitudinal wall of said outer box member being provided with a plurality of parallel slots juxtaposed with said openings, each of said slots extending from a free edge of said outer box member perpendicularly inwards from said free edge and towards the middle longitudinal wall of said outer box member and terminating short of said middle longitudinal wall;

a plurality of flexible cable means, an end of each of said cable means being receivable through one of the slots in said one side longitudinal wall of the outer box member and also through the juxtaposed one of the openings in said one side longitudinal wall of the inner box member; and means to secure at least one end of each of said cable means when extended through the juxtaposed slot and opening, at least one discrete item of portable property being mountable to each of said cable means.

2. The cable lock for portable property of claim 1; and further comprising:

a plurality of spaced nipples, said plurality of nipples being mounted to one side longitudinal wall of the inner box member and extending into the inner box member substantially perpendicular to said one side longitudinal wall of the inner box member, each of said nipples extending from one of said plurality of openings; wherein said rectilinear passage extends through each nipple, and wherein each cable means is receivable through said passage in the respective nipple.

3. The cable lock for portable property of claim 2 in which the means to secure at least one end of each of said cable means to its respective nipple is a set screw, said set screw extending transversely through a wall of the nipple and being mounted in a threaded passage in the wall of the nipple.

4. The cable lock for portable property of claim 1, in which the middle longitudinal wall of one of the box members is provided with a plurality of spaced openings, so that the middle longitudinal wall of said one box member is mountable to the mounting surface by mounting a fastening means through each of said spaced openings and into the mounting surface.

5. The cable lock for portable property of claim 1, in which the means to detachably secure the outer box member to the inner box member comprises a lock means.

6. The cable lock for portable property of claim 5, in which the lock means is mounted to the middle longitudinal wall of one of the box members, the inner end of said lock means terminating with a dependent lateral cam, said cam being perpendicularly mounted to the inner end of said lock means, so that said cam pivots about its mounted end when a key is inserted into said lock means and said lock means is rotated, one side longitudinal wall of at least the inner box member having a slot opposite to said cam.

7. The cable lock for portable property of claim 6, in which both the slot and the plurality of nipples are disposed in conjunction with the same one side longitudinal wall of said one box member.

8. The cable lock for portable property of claim 1, in which the item of portable property comprises a discrete item of office and school and hospital equipment.

9. The cable lock for portable property of claim 8, in which the item of office equipment comprises a calculator, dictating equipment, and word processing terminals.

10. The cable lock for portable property of claim 1, in which the three longitudinal walls of each of the box members are substantially rectangular, and the opposed side longitudinal walls of each of the box members are substantially perpendicular to the respective middle longitudinal wall of the box member.

11. A cable lock for portable property comprising a rectangular parallelepiped locking box, said locking box having an inner box member and an outer box member;

each of said box members having three longitudinal walls and two opposed end walls, the three longitudinal walls of each of said box members consisting of two opposed side longitudinal walls and a middle longitudinal wall, the two opposed side longitudinal walls of each of said box members being spaced apart in registration and straddling the middle longitudinal wall of the respective box member, each longitudinal edge of the middle longitudinal wall being joined to a longitudinal edge of one of the two opposed side longitudinal walls of each box member;

the inner box member being slidably engageable with and mateable with the outer box member, so that when said box members are mated and said locking box is integrally assembled, and when the opposed side longitudinal walls of said inner box member are within said outer box member, the middle longitudinal wall of the inner box member is then opposed to the middle longitudinal wall of the outer box member, and each of the opposed side longitudinal walls of the inner box member is contiguous with one of the opposed side longitudinal walls of the outer box member, and said inner box member is mated to and mounted in mirror image relationship within said outer box member;

the spacing between opposed side longitudinal walls of the inner box member being less than the spacing between opposed side longitudinal walls of the outer box member, the spacing between opposed end walls of the inner box member being less than the spacing between opposed end walls of the outer box member, so that the inner box member is receivable within the outer box member;

the width of the opposed side longitudinal walls of both the inner box member and the outer box member being substantially equal;

the middle longitudinal wall of one of the box members being mountable to a fixed mounting surface;

means to detachably secure the outer box member to the inner box member;

a plurality of spaced nipples, said plurality of nipples being mounted to one side longitudinal wall of the inner box member and extending into the inner box member substantially perpendicular to said one said longitudinal wall of the inner box member;

each of said nipples extending from one of a plurality of openings in said one side longitudinal wall of the inner box member, so that a continuous rectilinear passage is provided into said inner box member at each nipple;

one side longitudinal wall of said outer box member being provided with a plurality of parallel slots, each of said slots extending from a free edge of said outer box member perpendicularly inwards from said free edge and towards the middle longitudinal wall of said outer box member and terminating short of said middle longitudinal wall;

a plurality of flexible cable means, each of said cable means having an enlargement at one end, so that an item of portable property is mountable to the one end of each cable means, the other end of each of said cable means being receivable through the juxtaposed slots in said one side longitudinal wall of the outer box member, and also one of the openings in said one side longitudinal wall of the inner box member, and also through the juxtaposed passage in the associated nipple; and means to secure the other end of each of said cable means when extended through a nipple.

12. The cable lock for portable property of claim 11, in which a washer is freely mounted on each cable means, said washer being juxtaposed with said enlargement at the one end of said cable means.

13. The cable lock for portable property of claim 11, in which the means to secure the other end of each of said cable means to its respective nipple is a set screw, said set screw extending transversely through a wall of the nipple and being mounted in a threaded passage in the wall of the nipple.

14. The cable lock for portable property of claim 13, in which a recess is formed in the wall of the nipple at a position laterally opposite to the threaded passage.

15. The cable lock for portable property of claim 11, in which the middle longitudinal wall of one of the box members is provided with a plurality of spaced openings, so that the middle longitudinal wall of said one box member is mountable to a fixed mounting surface by mounting a fastening means through each of said spaced openings and into the fixed mounting surface.

16. The cable lock for portable property of claim 11, in which the means to detachably secure the outer box member to the inner box member comprises a lock means.

17. The cable lock for portable property of claim 16 in which the lock means is mounted to the middle longitudinal wall of one of the box members;

a cam depending laterally from the terminal inner end of said lock means;

said cam being perpendicularly mounted to the inner end of said lock means, so that cam pivots about its mounted end when a key is inserted into said lock means and said lock means is rotated;

one side longitudinal wall of at least the inner box member having a slot opposite to said cam.

18. The cable lock for portable property of claim 17 in which both the slot and the plurality of nipples are disposed in conjunction with the same one side longitudinal wall of said one box member.

19. The cable lock for portable property of claim 11 in which the item of portable property comprises a discrete item of portable office equipment.

20. The cable lock for portable property of claim 19 in which the item of office equipment comprises a calculator.

21. The cable lock for portable property of claim 11 in which the enlargement at the one end of each cable means is spherical.

22. The cable lock for portable property of claim 1 in which the three longitudinal walls of each of the box members are substantially rectangular, and the opposed side longitudinal walls of each of the box members are substantially perpendicular to the respective middle longitudinal wall of the box member.

23. The cable lock for portable property of claim 1, in which the other end of each of said cable means is receivable through another one of the slots in said one side longitudinal wall of the outer box member, and also through another one of said openings in said one side longitudinal wall of the inner box member, said flexible cable means thereby forming a closed loop on which a discrete item of portable property is mounted.

24. The cable lock for portable property of claim 23, in which the portable item has wall means bounding a channel through which the cable means is extended.

25. The cable lock for portable property of claim 1; and further comprising a loop-type attachment mounted on the discrete item, said attachment having an open loop portion through which the cable means is extended, and a threaded connector portion mounted on the item.

26. The cable lock for portable property of claim 2; and further comprising a recess in communication with and radially offset from said rectilinear passage extending through each nipple, said cable means having a radially offset cable portion receivable in said recess.

27. The cable lock for portable property of claim 2, wherein said end of the cable means has a rounded end insertable through the rectilinear passage, and wherein said securing means includes a snap-action clip mounted intermediate the rounded end and the locking box.

28. The cable lock for portable property of claim 1; and further comprising a mounting bracket having a through-passage, and an adhesive-bearing tape both arranged in juxtaposed relationship with the portable item, said cable means extending through said through-passage and having an enlargement at one end region of said through-passage.

* * * * *